US005323958A

United States Patent [19]

Liu et al.

[11] Patent Number: 5,323,958

[45] Date of Patent: Jun. 28, 1994

[54] PAPER BOARD FOLDABLE INTO A CONTAINER WITH MULTIPLE COMPARTMENTS

[76] Inventors: Yuan-Hsin Liu, 11th-1 Floor, No. 90, Fu Hsin S. Road, Sec. 1, Tah An District, Taipei; Richard C. H. Chang, 19, Alley 2, Lane 685, Chung Cheng Road, Fuan Yuan City, Taichung Hsien, both of Taiwan

[21] Appl. No.: 107,990

[22] Filed: Aug. 18, 1993

[51] Int. Cl.[5] ..... B65D 5/48

[52] U.S. Cl. ..... 229/120.17; 229/2.5 R; 229/120.12; 229/186

[58] Field of Search ..... 229/2.5 R, 120.12, 120.17, 229/125.35, 186; 220/416, 417, 462

[56] References Cited

U.S. PATENT DOCUMENTS

| | | | |
|---|---|---|---|
| 2,591,548 | 4/1952 | Inman | 229/120.17 |
| 3,084,790 | 4/1963 | Vander Lugt, Jr. | 229/120.17 |
| 3,771,713 | 11/1973 | Davidson | 229/120.12 |
| 4,192,443 | 3/1980 | McLaren | 229/120.17 |
| 4,202,465 | 5/1980 | McLaren | 229/120.17 |
| 4,722,474 | 2/1988 | Dropsy | 220/462 |
| 4,944,451 | 7/1990 | Forbes, Jr. | 229/125.35 |
| 5,009,363 | 4/1991 | Zavatone | 229/120.17 |
| 5,056,709 | 10/1991 | Cargile, Jr. | 229/120.17 |
| 5,236,119 | 8/1993 | Chu | 229/2.5 R |

*Primary Examiner*—Gary E. Elkins
*Attorney, Agent, or Firm*—Bacon & Thomas

[57] ABSTRACT

A paper container with multiple compartments which is formed from a paper board of adequate thickness cut into a predetermined pattern. The paper board is made of paper of pure fibers and additives, laminated to adequate thickness and coated with polyethylene to meet the FDA regulations. The paper pattern is formed with two inner transversely disposed openings and embossed with a plurality of folding lines to define multiple bottom sections, partitioning wall sections, side wall sections, corner connection sections, and top edge strip sections, whereby the paper pattern can be folded about the folding lines and heat-sealed by means of molds to form a container having multiple compartments, allowing the paper container to be more suitable for containing various foods or articles.

3 Claims, 3 Drawing Sheets

PAPER BOARD FOLDABLE INTO A CONTAINER WITH MULTIPLE COMPARTMENTS

BACKGROUND OF THE INVENTION

The present invention relates to a paper container with multiple compartments. The paper container is formed from a paper board in adequate thickness. The paper board is cut into a predetermined pattern, whereby the paper board can be folded and heat-sealed to form the paper container having multiple compartments for more suitably containing various foods or articles in different shapes and volumes.

Conventional food containers are mainly made of paper, polymer or plastic, wherein the polymer-made container is integrally formed from the foaming material and the plastic-made container is formed from melted plastic molded in a set of upper and lower molds. Both of the polymer and plastic made food containers can be formed with several compartments to meet the requirements of containing foods. Basically, the advantages of these partitioned polymer and plastic made food containers are convenience in use and ease of manufacture. However, such containers are not subject to natural decomposition after they are used and discarded, and therefore, will cause serious pollution of and detriment to the whole ecological environment that will cost the entire society a higher price to protect the environment. Therefore, the polymer and plastic food containers are gradually given up by the users.

The paper container is mainly made from a paper board cut into a predetermined pattern with a plurality of folding lines embossed in advance which define several sections of the container. The paper board can be folded about the pre-embossed folding lines such that four wall sections and corner sections are formed, then, the corner sections so formed are overlapped and attached to the wall sections to form a container having one single compartment. To contain different kinds of solid or liquid foods without mixing their different tastes and flavors, several partitioning paper cards are disposed inside the container, giving it several compartments. Such paper cards are not fixedly disposed and are likely to shift due to the movement of the contained foods. As a result, the contained foods are still easy to mix with one another and lose their original tastes. Although the paper container is subject to natural decomposition and the environment pollution caused thereby is relatively low, the conventional paper container is not so practical in use and would need improvement.

It is therefore tried by the applicant to develop a paper container which has secure multiple compartments and can be easily manufactured to eliminate the above shortcomings existing in the conventional paper container.

SUMMARY OF THE INVENTION

It is a primary object of the present invention to provide a paper container with multiple compartments. The paper container is formed from a paper board meeting the FDA regulations by cutting the same into a predetermined pattern which is embossed with a plurality of folding lines to define multiple bottom sections, side wall sections and partitioning wall sections, wherein the partitioning wall sections are located between two adjacent edges of the bottom sections while the side wall sections adjoin edges of the bottom sections that are not adjacent to any other bottom sections. Some of the side wall sections are provided with top edge strip sections. Each corner of the paper pattern contained by two adjacent wall sections consists of two adjacent identical and equiangular triangle-shaped corner connection sections. All the adjacent corner connection sections and the top edge strip sections can be folded, overlapped and heat-sealed to the corresponding side wall sections by molds to form the paper container with multiple compartments for more suitably and conveniently containing different kinds of foods.

It is a further object of the present invention to provide the above paper container, wherein four bottom sections are separately located at a front, a rear, a left and a right sides of the paper pattern and the top edge strip sections thereof adjoin outer edges of the side wall sections of the front, left and right bottom sections. The top edge strip section adjacent to the front bottom section has two projected end portions while the top edge strip sections adjacent to the left and right bottom sections each has only a rearward projected end portion. Two ends of each of the top edge strip sections are outward tapered to form two slightly inclined lateral sides, whereby the top edge strip sections can be folded outward and heat-sealed to corresponding adjacent side wall sections with their top edge flush with the top edge of the adjacent side wall sections, forming a neat and secure top edge of the paper container.

It is still a further object of the present invention to provide the above paper container, wherein some of the partitioning wall sections of the bottom sections can be alternatively designed to have less width and the adjacent corner connection sections can correspondingly have less height so that after the paper pattern is folded and heat-sealed to form the container, the same will have lower partitioning walls.

It is still a further object of the present invention to provide the above paper container, wherein the numbers of the bottom sections can be increased or decreased and the partitioning wall sections and corner connection sections can be varied to give the paper container multiple compartments in different sizes and shapes.

The structure, features, functions, and other objects of the present invention, and the technical means adopted to achieve the present invention can be best understood through the following detailed description of the preferred embodiment and the accompanying drawings wherein:

DETAILED DESCRIPTION OF THE PREFERRED EMBODIMENTS

Figure 1:
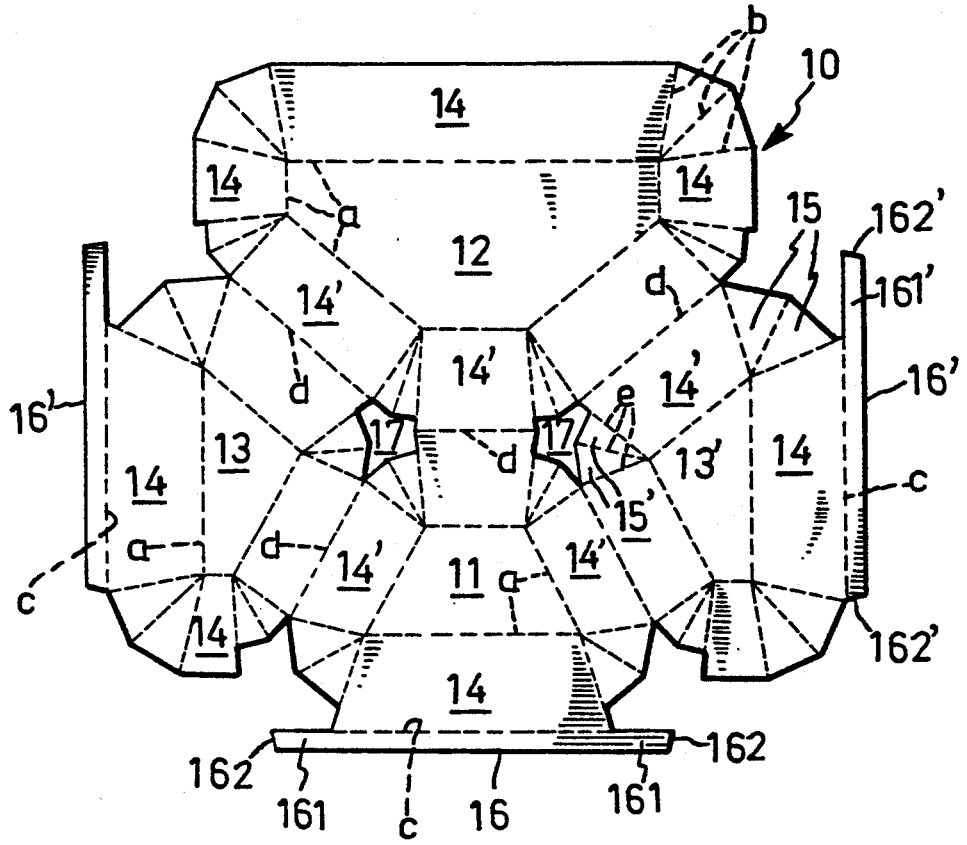
FIG. 1 is an unfolded paper pattern of the paper container according to the present invention.

The present invention is a paper container 10 which is formed from a paper board made of paper formed from pure fibers and additives being laminated to adequate thickness and coated with polyethylene to meet the FDA regulations. The paper board is cut to a paper pattern of predetermined configuration. The paper pattern of FIG. 1 is formed with two laterally symmetrically disposed openings 17 and a plurality of embossed folding lines a, b, c, d, e, whereby the paper pattern can be folded about the folding lines a through e and heat-sealed by means of molds to form a container 10 having four generally laterally symmetrical compartments 11, 12, 13, and 13'. To meet different requirements, the positions of the two openings 17 can be changed to give the compartments 11, 12, 13, 13' different sizes and shapes for containing more kinds of food in a perfect manner.

Please now refer to FIG. 1 which shows an unfolded paper pattern for forming the paper container 10 of the present invention, wherein the folding lines a are lines defining peripheral edges of the bottom sections 11, 12, 13, 13'. Bottom sections 11, 12, 13, 13' are connected with one another by partitioning wall sections 14' with folding lines d located between two adjacent partitioning wall sections 14' whereby the adjacent partitioning wall sections 14' can be folded about the folding lines d to form an erected wall to separate the bottom sections 11, 12, 13, and 13' from one another, as shown in FIG. 2.

Side wall sections 14 are adjacent to those edges a of bottom sections 11, 12, 13, 13' that are not adjacent to partitioning wall sections 14'. Three folding lines b or e are embossed at each corner section contained by two adjacent wall sections 14 and/or 14', permitting each of the corner sections to form two adjacent and identical equiangular triangle-shaped corner connection sections 15 or 15', wherein corner connection sections 15' are those corner connection sections contained by two partitioning wall sections 14'. Bases of the corner connection sections 15' adjoin the two openings 17. Each two adjacent corner connection sections 15, 15' can be folded upward and overlapped to facilitate the forming of the four compartments 11, 12, 13, 13' as shown in FIG. 3.

The side wall sections 14 adjoining the front, left and right bottom sections 11, 13 and 13' further adjoin at an outer edge thereof two longitudinal top edge strip sections 16' and a transverse top edge strip section 16, wherein the transverse top edge strip section 16 is located in front of the front bottom section 11 and each end of the transverse top edge strip section 16 has a projected portion 161 which is outward tapered, forming a slightly inclined lateral side 162. The two longitudinal top edge strip sections 16' separately locates in front of the right and the left bottom sections 13, 13' and each has a rearward projected end portion 161'. Both longitudinal top edge strip sections 16' have two ends which are similarly formed to be slightly inclined sides 162'.

Figure 2:
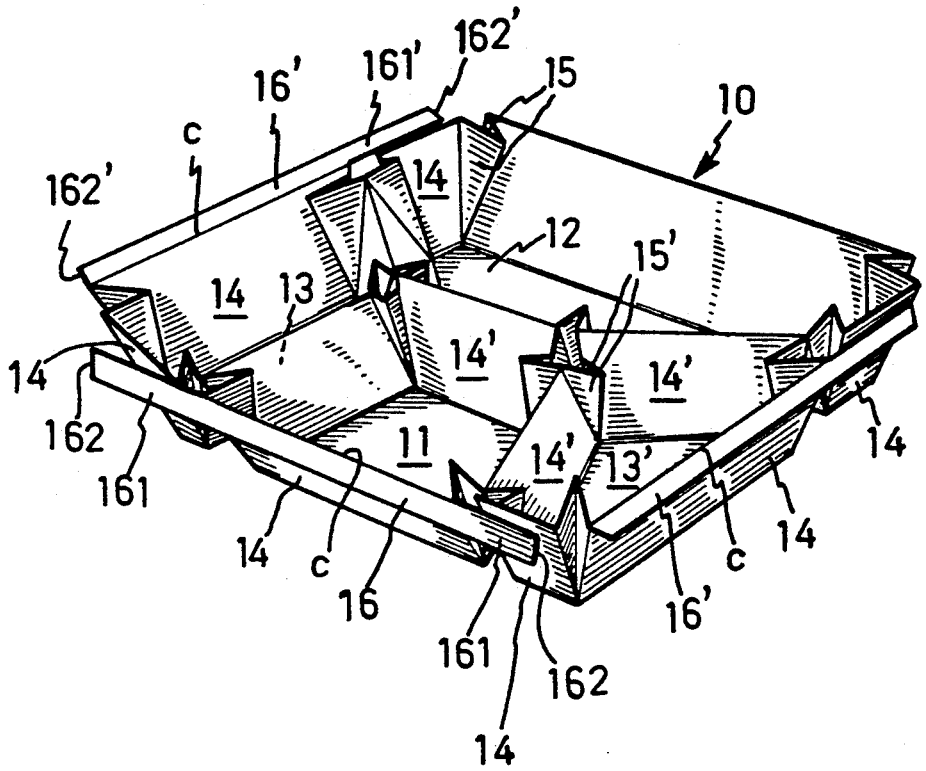
FIG. 2 shows the manner in which the paper container according to FIG. 1 is folded.
Figure 3:
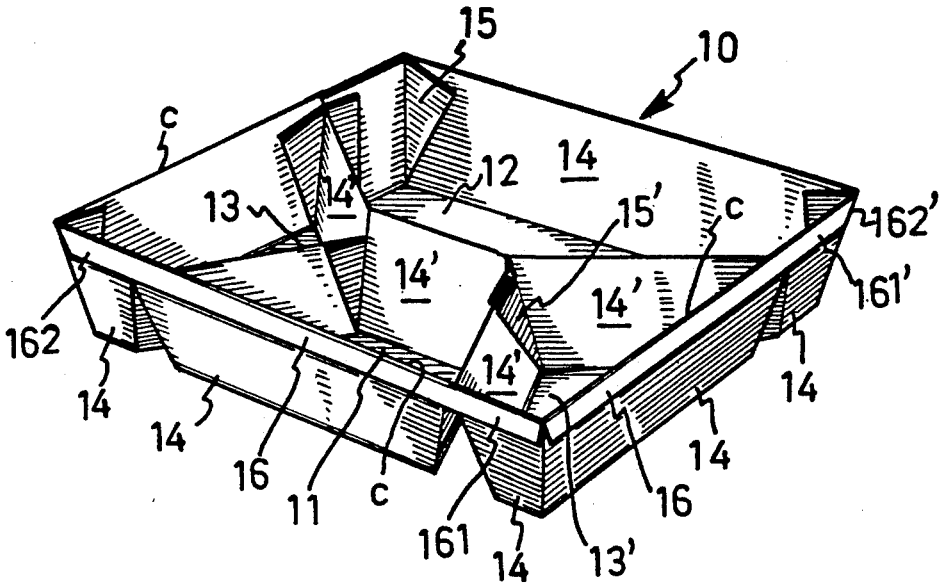
FIG. 3 shows the paper container folded, heat-sealed and finally formed from the paper pattern of FIG. 1.

Please refer to FIGS. 2 and 3. The transverse and longitudinal top edge strip sections 16, 16' can be folded outward about the folding lines c so that they can be separately fitted and attached to and heat-sealed to the adjacent side wall sections 14 with the projected portions 161, 161' flush with the top edge of the side wall sections 14 of the adjacent bottom sections 12, 13 and 13'. Because the top edge strip sections 16, 16' have two inclined sides 162, 162', they can be attached and heat-sealed to the side wall sections 14, forming neatly connected and enhanced corners of the container 10.

In addition, some of the partitioning wall sections 14' of the bottom sections 11, 12, 13 and 13' can be alternatively designed to have less width (not shown) and the adjacent corner connection sections 15' can correspondingly have reduced dimemsions such that when the paper pattern is folded and heat-sealed to form the paper container, the same will have partitioning walls 14' with lower heights for more suitably containing different foods or articles having various shapes and volumes. Moreover, the numbers of the bottom sections 11, 12, 13 and 13' can be increased or decreased; or the positions of related partitioning wall sections 14' and corner connection sections 15' can be varied so as to change the sizes, shapes and positions of the bottom sections 11, 12, 13 and 13' for creating different containing effects.

According to the above arrangements, the present invention can provide paper containers with multiple compartments for containing different articles or foods. Moreover, the partitioning walls of the container can have various heights to more suitably contain the articles or foods with different shapes or volumes.

It is to be understood that the above description and drawings are only used for illustrating one embodiment of the present invention, and not intended to limit the scope of the present invention. Any variation and derivation from the above description and drawings should be included in the scope of the present invention.

What is claimed is:

1. A paper board foldable into a container with multiple compartments, the paper board formed from a polyethylene coated laminate of fibers and additives, and including a pattern comprising:

a) two laterally and symmetrically disposed pre-cut openings within the pattern;

b) a plurality of first folding lines defining four bottom sections;

c) a plurality of pairs of partitioning wall sections, each pair of partitioning wall sections being located between two adjacent bottom sections and provided with a second folding line extending transversely therebetween, whereby each pair of partitioning wall sections may be folded about the second folding line to form an erected partitioning wall for separating the two adjacent bottom sections from each other;

d) a plurality of side wall sections, each side wall section adjoining one edge of a bottom section, and the bottom sections not adjoining each other;

e) a plurality of corner connection sections, each corner connection section being contained by either two partitioning wall sections, two side wall sections or a partitioning wall section and a side wall section, and each corner connection section being defined by three third folding lines for forming two adjacent equiangular triangles which may be folded and overlapped together; and f) a top edge strip section adjoining each of three side wall sections corresponding to three of the bottom sections, a fourth folding line between each top edge strip section and its adjoined side wall section, and each top edge strip section having at least one projected end portion for folding toward and heat-sealing to its adjoined side wall section to form a secured top edge of the container.

2. The paper board of claim 1 wherein:

a) the four bottom sections form front, rear, left and right bottom sections of the pattern;

b) the top edge strip sections include two longitudinal top edge strip sections and one transverse top edge strip section;

c) the two longitudinal top edge strip sections separately adjoin two side wall sections located at outer lateral sides of the right and left bottom sections;

d) the transverse top edge strip section adjoins a side wall section located in front of the front bottom section;

e) the longitudinal top edge strip sections each having a rearwardly projected end portion and the transverse top edge strip section having two projected end portions; and f) each of the top edge strip sections having two outward tapered ends, each end defining an inclined side for forming smooth top edges of the container when the top edge strip sections are folded and heat-sealed to side wall sections of the container.

3. The paper board of claim 1 wherein the partitioning wall sections and the bottom sections are of different widths for forming partitioning walls of different heights when the pattern is folded and heat-sealed to form the container.

* * * * *